United States Patent [19]

Hansen

[11] Patent Number: 5,076,474

[45] Date of Patent: Dec. 31, 1991

[54] DROPPER BOTTLE WITH FRANGIBLE OUTLET ELEMENT

[76] Inventor: Bernd Hansen, Heerstrasse 16, 7166 Sulzbach-Laufen 2, Fed. Rep. of Germany

[21] Appl. No.: 260,778

[22] Filed: Oct. 21, 1988

[30] Foreign Application Priority Data

Oct. 23, 1987 [DE] Fed. Rep. of Germany ..... 3735909

[51] Int. Cl.[5] ..... B67D 47/18; B65D 47/10

[52] U.S. Cl. ..... 222/420; 222/541

[58] Field of Search ..... 222/206, 212, 215, 420, 222/421, 541

[56] References Cited

U.S. PATENT DOCUMENTS

| | | | |
|---|---|---|---|
| 2,295,865 | 9/1942 | Rentschler | 222/541 X |
| 2,800,253 | 7/1957 | Henderson | 604/298 X |
| 2,987,223 | 6/1961 | Armour | 222/420 X |
| 3,731,848 | 5/1973 | Nakanishi | 222/420 X |
| 3,777,949 | 12/1973 | Chiquiari-Arias | 222/541 |
| 4,157,765 | 6/1979 | Golebiewsky | 222/541 X |
| 4,358,028 | 11/1982 | Chiquiari-Arias | 222/541 X |
| 4,425,090 | 1/1984 | Hansen | 264/525 X |
| 4,566,613 | 1/1986 | Anscomb | 222/541 |
| 4,688,703 | 8/1987 | Bayer | 222/541 |
| 4,787,536 | 11/1988 | Winderström | 222/541 X |

FOREIGN PATENT DOCUMENTS

| | | | |
|---|---|---|---|
| 2446564 | 4/1976 | Fed. Rep. of Germany . | |
| 3033821 | 4/1982 | Fed. Rep. of Germany . | |
| 347763 | 8/1960 | Switzerland | 222/541 |

*Primary Examiner*—Kevin P. Shaver

*Attorney, Agent, or Firm*—Roylance, Abrams, Berdo & Goodman

[57] ABSTRACT

The dropper part of a plastic dropper bottle is constructed in one piece with the head of the bottle. The dropper bottle is made from a tube of heat-sealable material. Following formation of the bottle body, a portion of the bottle body with a calibrated inside area is formed into a dropper.

12 Claims, 1 Drawing Sheet

DROPPER BOTTLE WITH FRANGIBLE OUTLET ELEMENT

FIELD OF THE INVENTION

The present invention relates to a plastic dropper bottle and to a method of manufacturing a plastic dropper bottle.

BACKGROUND OF THE INVENTION

In one known dropper bottle of this type, the head of the blow molded bottle has a calibrated seat receiving a spray-cast additional dropper member. In another known dropper bottle produced from a tube of heat-sealable plastic, a dropper is introduced and embedded in the head of the bottle in a known manner (German Offenlegungsschrift 30 33 821) in place of a rubber plug in the head of the bottle before final formation of the head. With both of these bottles, the dropper considerably increases the manufacturing costs and the costs for assembly of the bottle. Also, it is nearly impossible to guarantee that the dropper bottle will be totally sterile.

SUMMARY OF THE INVENTION

Objects of the present invention include providing a dropper bottle and a method for its manufacture which reduces production costs and permits total sterility.

The foregoing objects are obtained by a dropper bottle of synthetic resin, comprising a bottle body having a head at one end thereof, and a dropper member integrally and unitarily formed as one piece with the head.

As a result of the structural configuration of the dropper member as one integral or unitary piece with the head of the bottle, the costs for the manufacture of a separate dropper and its introduction into a dropper bottle are eliminated. Since the dropper member is formed together with the bottle, this dropper bottle can be produced at practically as low cost as a bottle without a dropper member. The one-piece configuration of the dropper member with the bottle additionally permits complete sterility as easily as in the case of bottle without a dropper member.

Preferably, the dropper bottle head comprises frustoconical upper segment tapering toward its discharge, and the dropper member comprises a frustoconical segment tapering toward the connection of the frustoconical segments.

Advantageously, a locking member can be formed and applied by tip-stretching over the dropper member. The locking member closes the bottle at the earliest possible point in time in the manufacturing operation and eliminates the danger that the bottle will be opened unintentionally. In order to be able to open the bottle without any inconvenience, a predetermined breaking point can be provided preferably between the locking member and the dropper member. When the locking member is configured with a non-circular periphery, this locking member can be easily broken off. The predetermined breaking point can be configured so that no sharp edges occur with the rupture. Furthermore, it is advantageous that no additional tools need be available to open the bottle.

The foregoing objects are also obtained by a method of producing a unitary, one-piece dropper bottle having a bottle body with a head at one end thereof and a dropper member extending from the head, comprising the steps of forming a tube of heat-sealable plastic into a bottle shape with a head at one end thereof, and calibrating at least an axially extending portion of an inner surface of the head to form a dropper means.

Both the manufacture of the bottle from a tube of heat-sealable plastic and the formation of a dropper means from a calibrated part of the head of the bottle are accomplished by cost-saving work steps. The bottle can be filled between the individual work steps for formation of the bottle body and its head, allowing the manufacture of a sterile container in one single operation which includes the filling of the bottle, the tip-stretch formation of the dropper, and the subsequent tight sealing of the bottle, without requiring additional parts.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENT

Figure 1:
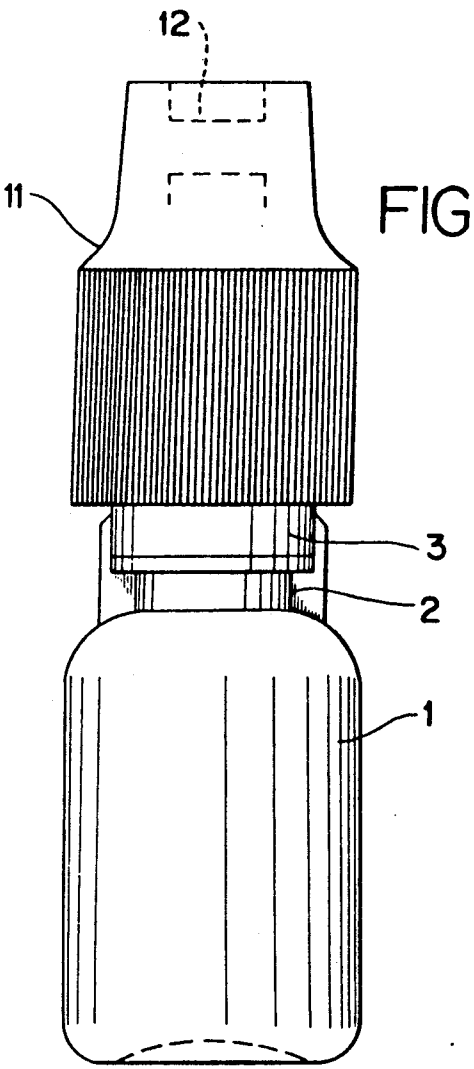
FIG. 1 is a side elevational view of a dropper bottle, ready for market, according to a first embodiment of the present invention.

A dropper bottle, serving as a medication ampoule for a liquid medication, as shown in FIG. 1, has a cylindrical bottle body 1. The bottom part of the bottle body is curved slightly inward. The head or top of the bottle is connected in the center to the bottle body 1 by a first cylindrical segment 2.

First segment 2 is followed by a second segment 3, of larger diameter, which carries an outside or external thread 4. Between two sequentially adjacent pitches or crest turns of the thread, outside thread 4 is provided with a stop-bar 5 extending parallel to the lengthwise axis of the head of the bottle. Opposite to stop bar 5 and offset by 180 degrees, a brake bar (not shown) is arranged The length of the brake bar coincides with only half of the axial spacing of the adjacent pitches or crest turns outside thread 4.

Second cylindrical segment 3 extends into a third segment 6 of the head of the bottle The third segment diameter is only approximately half that of first cylindrical segment 2. From a cylindrical annular zone of third segment 6, third segment 6 extends into a truncated conical or frustoconical zone. The truncated conical zone tapers toward the free end of the head of the bottle and forms a part of a dropper member, which dropper member is indicated in its entirety with reference 7.

The one-piece dropper member 7 is constructed to be an integral, unitary, one-piece part of the head of the bottle, and has a segment 8 connected with the third segment 6. Segment 8 is frustoconical and tapers conically downwardly, widening upwardly toward its free end.

The outside surface and the inside surface of conical segment 8 have a cone angle of approximately 10 degrees. The calibrated passage 8', formed on the inside surface of conical segment 8, has a diameter of about 0.3 mm at the point where, in the exemplary embodiment shown in FIG. 2, it opens into the inside chamber 6' of third segment 6. The other end of calibrated passage 8', to which is connected a short inside conical surface 9 with a cone angle of 60 degrees, has a diameter of about 1.5 mm in the exemplary embodiment.

Conical segment 8, however, can have other dimensions, adapted to the desired configuration of the drops of the liquid. Furthermore, a cylindrical passage segment can be provided between calibrated passage 8' and inside chamber 6', which segment would preferably be calibrated.

At the end of dropper member 7, opposite or remote from third segment 6, a generally cubical breechblock-type locking member 10 is mounted. Locking member 10 is tip-stretched in place in one piece, and slightly overlaps the end of dropper member 7 remote from bottle body 1. Additionally, the locking member tightly locks dropper member 7, and thus, the entire bottle shut. In the area of the overlap over dropper member 7, the connecting area or wall between locking member 10 and dropper member 7 is of a material sufficiently thin to provide a predetermined breaking point. Locking member 10 can be separated from dropper member 7 by a simple rotary motion along this predetermined breaking point, without forming sharp tear edges.

When ready for marketing, a plastic cap 11 is mounted on the dropper bottle. The cap is provided with an inside thread which engages outside thread 4 of bottle second cylindrical segment 3. As shown on the right side of FIG. 2, cap 11 can taper upwardly from the cylindrical segment supporting the inside thread toward an end segment of the cap surrounding locking member 10. The cap end segment engages the non-circular outside surface of locking member 10. Thus, the cap is connected non-rotatably with locking member 10. Upon a rotation of cap 11 in the direction for removal from the head of the bottle, locking member 10 is separated from dropper member 7.

Figure 2:
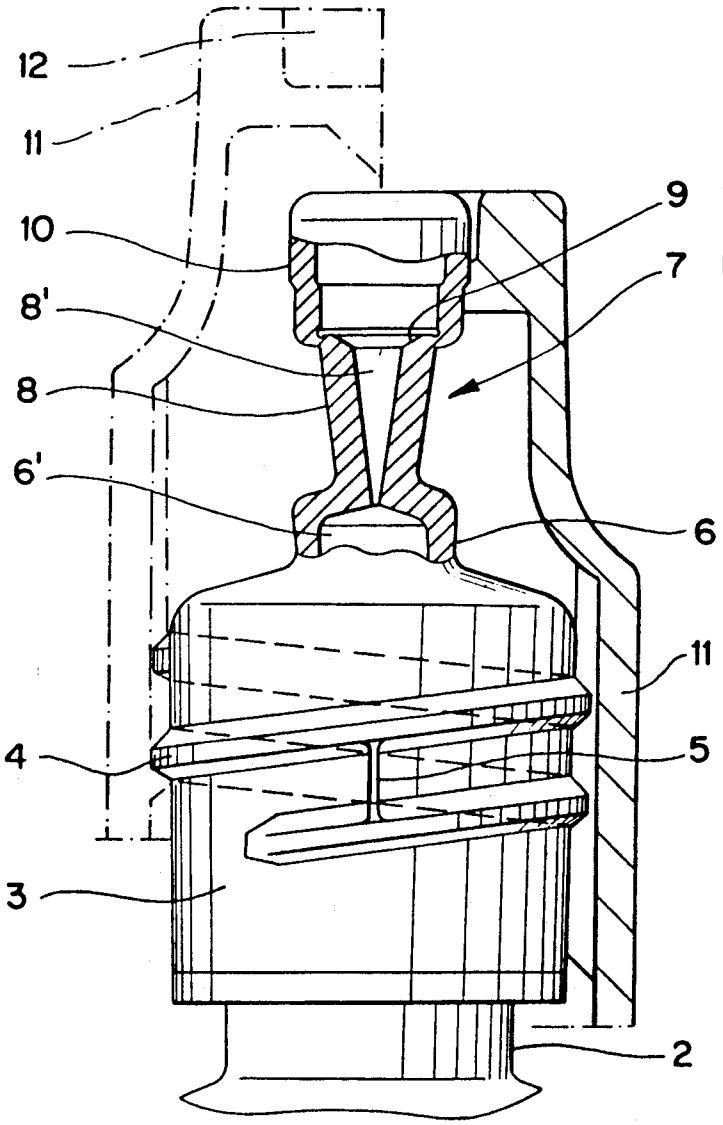
FIG. 2 is a partial side elevational view in section of a dropper bottle according to alternative embodiments of the present invention.

However, as shown on the left side in FIG. 2, the cap can be configured to normally cover locking member 10. To separate locking member 10 from dropper member 7, cap 11 is mounted reversed or up-side-down on locking member 10. For this purpose, the cap can have a recess 12 in its front or top wall. The recess dimensions are adapted to the outside contour of locking member 10 and engages cap 11 in the manner of a ring spanner of a wrench.

The entire bottle is produced from an extruded tube of a heat-sealable synthetic resin material. The body of the bottle 1 is formed first with the aid of two bottom-half molds used for the production, filling and closing of bottles. Simultaneously, the first cylindrical segment 2 and the second cylindrical segment 3 of the head of the bottle obtain their final form, each with the aid of one cheek or holding member for each two mold halves. Thereafter, the liquid contents are filled into the body of the bottle in the desired volume through a filler tap protruding from a calibration mandrel. The filler tap is then drawn back to a point such that the calibration mandrel lies inside that segment of the tube from which dropper member 7 is formed with the aid of calibration cheeks. The calibration cheeks are moved toward each other and together with the calibration mandrel form dropper member 7. After formation of the dropper member, the calibration mandrel is withdrawn from the top end of the tube. Then locking mechanism 10 is formed by shaping cheeks of the top mold halves to close the bottle. Finally, cap 11 is mounted on the dropper bottle.

While various embodiments have been chosen to illustrate the invention, it will be understood by those skilled in the art that various changes and modifications can be made therein without departing from the scope of the invention as defined in the appended claims.

What is claimed is:

1. A one piece dropper bottle formed of a tube of heat-sealable synthetic resin, comprising:
   - a bottle body having a head integrally and unitarily formed as one piece at one end thereof;
   - a dropper member integrally and unitarily formed as one piece with said head, said dropper member having a frustoconical segment with a frustoconical inside chamber tapering toward a conical segment having a calibrated passage widening in a direction away from said frustoconical segment; and
   - a locking member integrally and unitarily formed as one piece with said dropper member at an end of said conical segment remote from said frustoconical segment.

2. A dropper bottle according to claim 1 wherein said locking member is generally cubical.

3. A dropper bottle according to claim 1 wherein said dropper member and said locking member are coupled by a relatively thin, frangible section.

4. A dropper bottle according to claim 1 wherein said bottle is filled with sterile contents.

5. A dropper bottle according to claim 1 wherein locking member has a non-circular peripheral contour; and a locking cap is mounted over said locking member, said cap having inside contour means for forming a non-rotatable connection between said cap and said locking member.

6. A dropper bottle according to claim 5 wherein said locking cap and said head of said bottle body have mating threads.

7. A one piece dropper bottle formed from a tube of heat-sealable synthetic plastic resin, comprising
   - a bottle body having a generally cylindrical head integrally and unitarily formed as one piece at one end thereof;
   - a dropper member integrally and unitarily formed as one piece with said head on an end thereof remove from said body, said dropper member having an upper frustoconical segment with a frustoconical chamber tapering toward a lower, frustoconical segment having a frustoconical chamber widening in a direction away from said upper frustoconical segment and toward said bottle body;
   - a calibrated opening joining said frustoconical chambers; and
   - a locking member integrally and unitarily formed as one piece with said dropper member at an end of said upper frustoconical segment remote from said lower frustoconical segment.

8. A dropper bottle according to claim 7 wherein said locking member is generally cubical.

9. A dropper bottle according to claim 7 wherein said dropper member and said locking member are coupled by a relatively thin, frangible section.

10. A dropper bottle according to claim 7 wherein said bottle is filled with sterile contents.

11. A dropper bottle according to claim 7 wherein said locking member has a non-circular peripheral contour; and a locking cap is mounted over said locking member, said cap having inside contour means for forming a non-rotatable connection between said cap and said locking member.

12. A dropper bottle according to claim 7 wherein said locking cap and said head of said bottle body have mating threads.

* * * * *